US008588445B2

(12) United States Patent
Ito et al.

(10) Patent No.: US 8,588,445 B2
(45) Date of Patent: Nov. 19, 2013

(54) HEARING AID PROCESSING APPARATUS, ADJUSTMENT APPARATUS, HEARING AID PROCESSING SYSTEM, HEARING AID PROCESSING METHOD, AND PROGRAM AND INTEGRATED CIRCUIT THEREOF

(75) Inventors: Gempo Ito, Kanagawa (JP); Atsunobu Murase, Kanagawa (JP); Megumi Yokokura, Kanagawa (JP)

(73) Assignee: Panasonic Corporation, Osaka (JP)

( * ) Notice: Subject to any disclaimer, the term of this patent is extended or adjusted under 35 U.S.C. 154(b) by 556 days.

(21) Appl. No.: 12/530,696

(22) PCT Filed: Jan. 8, 2009

(86) PCT No.: PCT/JP2009/000041

§ 371 (c)(1),
(2), (4) Date: Sep. 10, 2009

(87) PCT Pub. No.: WO2009/087968

PCT Pub. Date: Jul. 16, 2009

(65) Prior Publication Data

US 2010/0046777 A1 Feb. 25, 2010

(30) Foreign Application Priority Data

Jan. 10, 2008 (JP) ..... 2008-003558
Jun. 27, 2008 (JP) ..... 2008-169373

(51) Int. Cl.
*H04R 25/00* (2006.01)

(52) U.S. Cl.
USPC ..... 381/320; 381/60; 381/17; 381/312; 381/315

(58) Field of Classification Search
None
See application file for complete search history.

(56) References Cited

U.S. PATENT DOCUMENTS 4,366,349 A * 12/1982 Adelman ..... 381/316
5,027,410 A * 6/1991 Williamson et al. ..... 381/320

(Continued)

FOREIGN PATENT DOCUMENTS

CN 101036417 9/2007
JP 2001-95784 4/2001

(Continued)

OTHER PUBLICATIONS

Christopher J. Plack, Andrew J. Oxenham, and Vit Drga, "Linear and Nonlinear Processes in Temporal Masking", Acta Acustica united with Acustica, vol. 88, No. 3, May/Jun. 2002 , pp. 348-358(11), Published by: S. Hirzel Verlag.*

(Continued)

*Primary Examiner* — Duc Nguyen
*Assistant Examiner* — Taunya McCarty
(74) *Attorney, Agent, or Firm* — Wenderoth, Lind & Ponack, L.L.P.

(57) ABSTRACT

A hearing aid processing apparatus includes audio input units that receive input audio; hearing aid signal processing units that generate first and second output signals each having different frequency characteristics, from the input audio received by the audio input units, based on the characteristics of the band pass filter having the greatest bandwidth among virtual band pass filters composing an auditory filter of a listener. A first audio output unit outputs, as an audio, the first output signal generated by the hearing aid signal processing unit to the left ear of the listener; and a second audio output unit outputs, as an audio, the second output signal generated by the hearing aid signal processing unit to the right ear of the listener.

11 Claims, 10 Drawing Sheets

(56) References Cited

U.S. PATENT DOCUMENTS

| | | | | |
|---|---|---|---|---|
| 5,710,823 | A * | 1/1998 | Nagata et al. | 381/83 |
| 6,582,378 | B1 | 6/2003 | Nakaichi et al. | |
| 6,885,752 | B1 * | 4/2005 | Chabries et al. | 381/321 |
| 7,013,015 | B2 * | 3/2006 | Hohmann et al. | 381/318 |
| 7,020,296 | B2 * | 3/2006 | Niederdrank | 381/315 |
| 2008/0049951 | A1 * | 2/2008 | Avendano et al. | 381/94.2 |
| 2008/0082327 | A1 | 4/2008 | Murase et al. | |
| 2008/0130925 | A1 * | 6/2008 | Fischer et al. | 381/317 |

FOREIGN PATENT DOCUMENTS

| | | |
|---|---|---|
| JP | 2003-264892 | 9/2003 |
| JP | 2006-87018 | 3/2006 |
| WO | 2006/030752 | 3/2006 |

OTHER PUBLICATIONS

Brian C. J. Moore, Deborah A. Vickers, Christopher J. Plack, and Andrew J. Oxenham, "Inter-relationship between different psychoacoustic measures assumed to be related to the cochlear active mechanism", J. Acoust. Soc. Am. 106 (5), Nov. 1999, pp. 2761-2778.*

International Search Report issued Apr. 28, 2009 in International (PCT) Application No. PCT/JP2009/000041.

Barbara Franklin, "*The Effect of Combining Low-and-High-Frequency Passbands on Consonant Recognition in the Hearing Impaired*", Journal of Speech and Hearing Research, vol. 18, Dec. 1975, pp. 719-727.

D.S. Chaudhari et al., "*Dichotic Presentation of Speech Signal Using Critical Filter Bank for Bilateral Sensorineural Hearing Impairment*", Proc. 16$^{th}$ ICA (Seattle, Washington, U.S.A., Jun. 20-26, 1998), vol. (I), pp. 213-214.

Brian C.J. Moore, "*An Introduction to the Psychology of Hearing*", Academic Press, 1989, pp. 98-101.

Full English machine translation for JP 2003-264892 dated Aug. 7, 2012. JP 2003-264892 was previously submitted in the IDS filed on Sep. 10, 2009 along with an Abstract.

* cited by examiner

HEARING AID PROCESSING APPARATUS, ADJUSTMENT APPARATUS, HEARING AID PROCESSING SYSTEM, HEARING AID PROCESSING METHOD, AND PROGRAM AND INTEGRATED CIRCUIT THEREOF

BACKGROUND OF THE INVENTION

1. Technical Field

The present invention relates to a hearing aid processing apparatus which performs hearing aid and an adjustment apparatus.

2. Background Art

Hearing losses which require hearing aid are roughly divided into a conductive hearing loss and a sensorineural hearing loss depending on damaged parts.

In the case of a conductive hearing loss, an audio cannot be easily transmitted to an inner ear. However, once a vibration of the audio reaches the inner ear, a signal is transmitted through a route from auditory nerves without disturbances. Accordingly, impaired hearing ability is compensated by simply amplifying the audio inputted to the ear.

On the other hand, in the case of a sensorineural hearing loss, a vibration of an audio is transmitted to an inner ear as in the case of normal hearing people, but the nerves cannot be sufficiently excited due to deformation or loss of sensory cells. It is known that a sensorineural hearing loss decreases various auditory functions compared to the case of normal hearing people. Representative auditory characteristics include a loudness recruitment phenomenon, a decrease in frequency selective, a decrease in temporal resolution.

In the case of a sensorineural hearing loss, the minimum audible value is higher than that of normal hearing people, but a discomfort threshold value indicating a degree of discomfort caused by a loud audio does not vary from that of the normal hearing people. For this, once an audio reaches strength equal to or greater than the minimum audible value, loudness which is the sensory magnitude of the audio increases suddenly. This is called a loudness recruitment phenomenon.

Most of conventional hearing aids made focusing on such loudness recruitment phenomenon caused by a conductive hearing loss or a sensorineural hearing loss amplify the level of an input audio according to impaired degrees of hearing ability characteristics to reproduce audios. Other exemplary conventional hearing aids include a pair of monaural hearing aids which are separately mounted on right and left ears for binaural reproduction.

On the other hand, a decrease in frequency selective increases the influence of masking between frequency band components, in particular, the influence of masking of high frequency components by low frequency components (upward masking).

Hearing aid processing aiming to increase clarity of an input audio signal by reducing masking between frequency bands includes dichotic listening in which the input signal is divided on the frequency axis to be presented at the respective ears.

For example, in a report (see Non-patent Reference 1, for example), in the case where an audio is divided into two bands of a low band and a high band, and the low band and the high band are separately presented to the respective right and left ears of a hearing impaired person, the clarity of the audio is higher than the clarity obtained in the case where both the high and low bands are presented to one of the ears of the hearing impaired person.

In addition, in a report (see Non-patent Reference 2, for example), an audio clarity obtained from a person who suffers from a sensorineural hearing loss is increased in a shown hearing aid processing of dividing an audio band into eighteen frequency bands and alternately assigning the adjoining bands to the respective right and left ears.

Non-patent Reference 1: Barbara Franklin, "The Effect of Combining low- and high-frequency passbands on consonant recognition in the hearing impaired", (US), Journal of Speech and Hearing Research, 1975

Non-patent Reference 2: D. S. Chaudhari and P. C. Pandey, "Dichotic Presentation of Speech Signal Using Critical Filter Bank for Bilateral Sensorineural Hearing Impairment", (US), Proc. 16th ICA, 1998

Non-patent Reference 3: B. J. C. Moore et. al., Chokaku shinrigaku gairon (General auditory psychology), pp. 105-108, Seishin Shobo, 1994

SUMMARY OF THE INVENTION

However, since people suffer from various kinds of hearing loss, methods according to Non-patent References 1 and 2 cannot provide an effect of sufficiently increasing clarity in some cases.

The present invention has been made to solve the conventional problems, and aims to provide a hearing aid processing apparatus which increases audio clarity for a greater number of listeners.

A hearing aid processing apparatus according to the present invention includes: an audio input unit configured to receive an input audio; a hearing aid signal processing unit configured to generate first and second output signals each having different frequency characteristics, from an input signal of the input audio received by the audio input unit, based on the characteristics of the band pass filter having the greatest bandwidth among virtual band pass filters composing an auditory filter of a listener: a first audio output unit configured to output, as an audio, the first output signal generated by the hearing aid signal processing unit to the left ear of the listener; and a second audio output unit configured to output, as an audio, the second output signal generated by the hearing aid signal processing unit to the right ear of the listener.

Varying the frequency characteristics of the audios to be outputted to the right and left ears based on the information related to the auditory filter of the listener in this way makes it possible to reduce masking occurring between the frequency components of the input signal. As a result, it becomes possible to increase audio clarity for a greater number of listeners.

In addition, the hearing aid signal processing unit may include a high pass filter which attenuates frequency components below a cut-off frequency selected in a specific band which is the band of the band pass filter having the greatest bandwidth so as to generate the first output signal from the input signal. With this, it is possible to effectively suppress upward masking.

Further, the hearing aid signal processing unit may further include a low pass filter which attenuates frequency components at and above the cut-off frequency of the input signal so as to generate the second output signal. With this, the high frequency components are outputted to the left ear and the low frequency components are outputted to the right ear, and thus it is possible to effectively prevent masking from occurring between frequency components.

In addition, the cut-off frequency may be selected in the band at and below the center frequency of the specific band. An appropriate cut-off frequency can be selected according to the characteristics of the listener's ears in this way. As a result, it becomes possible to increase audio clarity for a greater number of listeners.

In addition, the cut-off frequency may be selected in the band between the center frequency of the specific band and the frequency of a formant component included in the input audio received by the audio input unit. An appropriate cut-off frequency can be selected with additional consideration of the characteristics of the input audio varying with time in this way.

In addition, the hearing aid signal processing unit may be configured to make the cut-off characteristics of the high pass filter and the low pass filter sharper with decrease in difference between the center frequency of the specific band and the frequency of the formant component. An appropriate hearing aid signal processing can be performed based on the characteristics of the listener's ears and the input audio in this way.

In addition, the hearing aid signal processing unit may include: a first band stop filter which attenuates only a predetermined low frequency band below a cut-off frequency selected in a specific band which is the band of the band pass filter having the greatest bandwidth so as to generate the first output signal from the input signal; and a second band stop filter which attenuates only a predetermined high frequency band at and above the cut-off frequency so as to generate the second output signal from the input signal.

With these filters, the frequency components around the cut-off frequency are divided and separately outputted to the respective right and left ears, and the frequency components distant from the cut-off frequency are outputted to the right and left ears in an overlapped manner. As a result, it becomes possible to reduce masking occurring between frequency components and output audios that sound more natural to the listener.

An adjustment apparatus of the present invention assigns parameters to the hearing aid processing apparatus, based on information obtained from the listener, the adjustment apparatus including: an auditory filter information obtaining unit configured to obtain the characteristics of the band pass filter having the greatest bandwidth in the auditory filter of the listener; and a parameter setting unit configured to generate the parameters for generating, from the input signal, the first and second output signals, based on the characteristics obtained by the auditory filter information obtaining unit, and assign the parameters to the hearing aid signal processing unit. It is possible to increase audio clarity for a greater number of listeners by generating parameters based on the characteristics of the listeners' ears.

In addition, the parameter setting unit may be configured to generate parameters for making the cut-off characteristics of the filters composing the hearing aid signal processing unit sharper with increase in bandwidth of a specific band which is the band of the band pass filter having the greatest bandwidth. This makes it possible to increase audio clarity for listeners who suffer from a significant hearing loss and to output audios that sound more natural to listeners having a light hearing loss.

In addition, the hearing aid signal processing unit may be configured to generate parameters for making cut-off characteristics of the high pass filter and the low pass filter composing the hearing aid signal processing unit sharper with decrease in listener's temporal masking characteristics indicating the degree of resolution of a temporally-adjacent audio. This makes it possible to increase audio clarity for listeners who suffer from a significant hearing loss and to output audios that sound more natural to listeners having a light hearing loss.

In addition, the hearing aid signal processing unit may include: a high shelf filter which generates the first output signal from the input signal; and a low shelf filter which generates the second output signal from the input signal. The parameter setting unit may be configured to generate parameters for increasing a level difference more significantly with increase in bandwidth of a specific band which is the band of the band pass filter having the greatest bandwidth, the level difference being a maximum difference value between the frequency characteristics of the high pass filter and frequency characteristics of the low pass filter. This makes it possible to increase audio clarity for listeners who suffer from a significant hearing loss and to output audios that sound more natural to listeners having a light hearing loss.

In addition, the auditory filter information obtaining unit may be configured to obtain the characteristics of the listener's band pass filter having the greatest bandwidth using a notch noise method.

A hearing aid processing system according to the present invention includes: a hearing aid processing apparatus which outputs an audio which has been subjected to hearing aid signal processing to the right and left ears of a listener; and an adjustment apparatus which outputs parameters used in the hearing aid signal processing to the hearing aid processing apparatus. The adjustment apparatus includes: an auditory filter information obtaining unit configured to obtain the characteristics of the band pass filter having the greatest bandwidth in an auditory filter of the listener; and a parameter setting unit configured to generate the parameters based on the characteristics obtained by the auditory filter information obtaining unit, and assign the parameters to the hearing aid signal processing unit. The hearing aid processing apparatus includes: an audio input unit configured to receive an input audio; a hearing aid signal processing unit configured to generate first and second output signals each having different frequency characteristics, from an input signal of the input audio inputted by the audio input unit, by executing the hearing aid signal processing based on the parameters obtained from the parameter setting unit; a first audio output unit configured to output, as an audio, the first output signal generated by the hearing aid signal processing unit to the left ear of the listener; and a second audio output unit configured to output, as an audio, the second output signal generated by the hearing aid signal processing unit to the right ear of the listener.

A hearing aid processing method according to the present invention includes: receiving an input audio; generating first and second output signals each having different frequency characteristics, from an input signal of the input audio received in the receiving, based on the characteristics of the band pass filter having the greatest bandwidth among virtual band pass filters composing an auditory filter of a listener: outputting, as an audio, the first output signal generated in the generating to the left ear of the listener; and outputting, as an audio, the second output signal generated in the generating to the right ear of the listener.

A program according to the present invention causes a computer to execute: receiving an input audio; generating first and second output signals each having different frequency characteristics, from an input signal of the input audio received in the receiving, based on the characteristics of the band pass filter having the greatest bandwidth among virtual band pass filters composing an auditory filter of a listener: outputting, as an audio, the first output signal generated in the generating to the left ear of the listener; and outputting, as an audio, the second output signal generated in the generating to a right ear of the listener.

An integrated circuit according to the present invention includes: an audio input unit configured to receive an input audio; a hearing aid signal processing unit configured to generate first and second output signals each having different frequency characteristics, from an input signal of the input audio received by the audio input unit, based on the characteristics of the band pass filter having the greatest bandwidth among virtual band pass filters composing an auditory filter of a listener: a first audio output unit configured to output, as an audio, the first output signal generated by the hearing aid signal processing unit to the left ear of the listener; and a second audio output unit configured to output, as an audio, the second output signal generated by the hearing aid signal processing unit to the right ear of the listener.

It is to be noted that the present invention can be implemented not only as a hearing aid processing apparatus and an adjustment apparatus, but also as an integrated circuits which implement the functions of the hearing aid processing apparatus and the adjustment apparatus and as programs causing computers to execute these functions. As a matter of course, such programs can be distributed through recording media such as CD-ROMs and communication media such as the Internet.

According to the present invention, it is possible to increase audio clarity for a greater number of listeners because signals each having different frequency characteristics are separately transmitted to the respective right and left ears, based on information related to auditory filters.

NUMERICAL REFERENCES

Figure 1A:
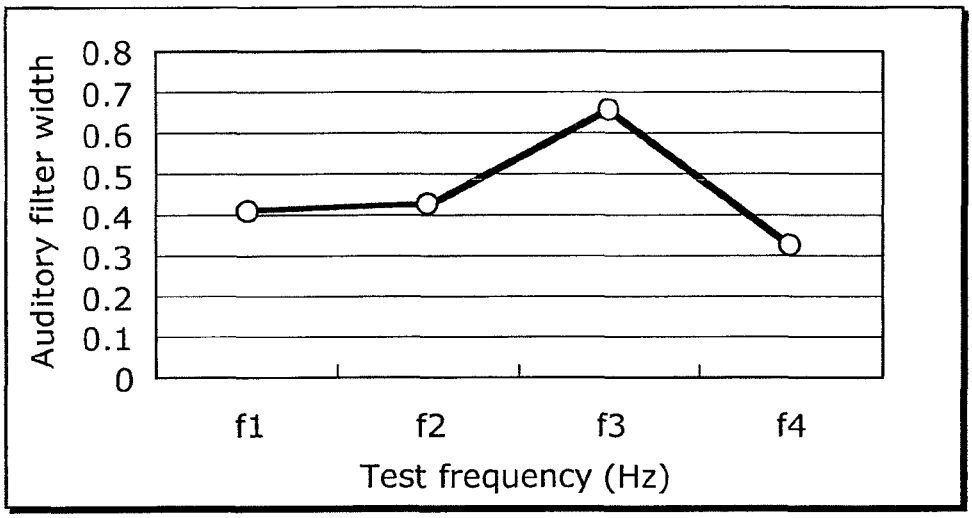
FIG. 1A is a diagram showing an exemplary auditory filter obtained by an adjustment apparatus.

100 Hearing aid processing apparatus
101, 121 Audio input unit
102, 122 A/D converter
103, 123 Parameter storage unit
104, 124 Hearing aid signal processing unit
105, 125 D/A converter
106, 126 Audio output unit
111 HPF
112, 132 BSF
131 LPF
150 Adjustment apparatus
151 Auditory filter information obtaining unit
152, 154, 203, 223, 204, 224 Parameter setting unit
153 Temporal masking information obtaining unit
207, 227 Auditory filter information storage unit
208, 228 Temporal masking information storage unit

DETAILED DESCRIPTION OF THE INVENTION

First, a description is given of an advantageous effect of increasing clarity of an audio by dichotic listening which forms a basis of the present invention.

As described above, it is known that such dichotic listening increases the clarity of the audio. However, the knowledge does not include any detailed consideration of the relationship between individual listeners and their masking characteristics.

Non-patent Reference 3 has shown that an organ called cochlears among human auditory organs perform a process of analyzing audio frequency components. This analysis process can be represented by rows of filters called auditory filter.

More specifically, the auditory filter can be considered to be an assembly of virtual band pass filters arranged on a frequency axis in an overlapped manner. Each of the band pass filters has a different pass bandwidth. It is further shown that the bandwidth of each band pass filter is closely related to its masking strength. In this DESCRIPTION, among the virtual band pass filters composing the auditory filter, the pass band of the band pass filter having a bandwidth expanded due to a hearing loss or the like is represented as "specific band" and the bandwidth of the specific band is represented as "auditory filter width".

The inventors of the present invention executed clarity tests of vowel-consonant-vowel (VCV) syllables by changing divided band frequencies for dichotic listening of hearing-impaired people who are subjects. Further, the widths of the auditory filters were measured on a per subject basis, and the widths were compared with the results of the clarity tests. It is to be noted that a general method such as a notch noise method as disclosed in Non-patent Reference 3 is used to measure the widths of the auditory filters.

The result showed the relationships between the widths of the auditory filters and the divided band frequencies which yield an advantageous effect of increasing clarity.

Figure 1B:
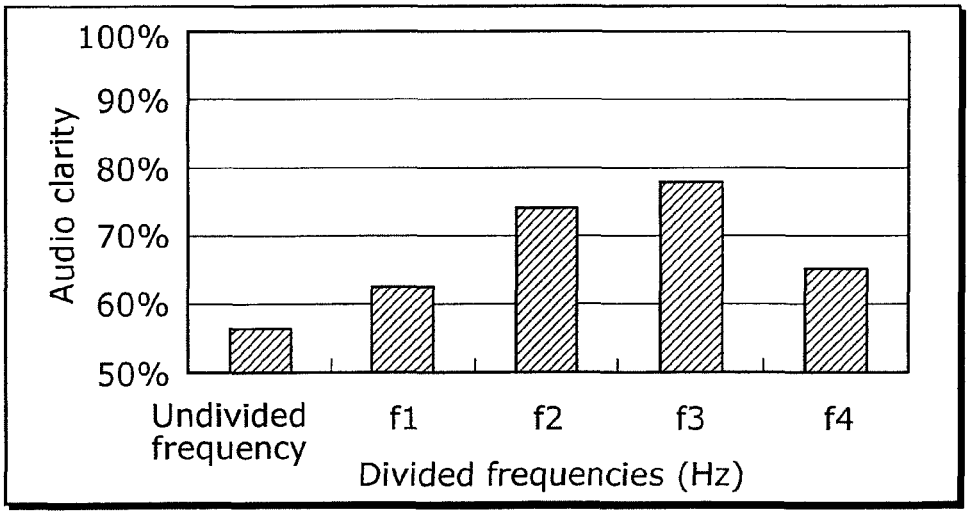
FIG. 1B is a diagram showing change in audio clarity in the case where each of the test frequencies in FIG. 1A is a cut-off frequency.

FIG. 1A is exemplary measurement results of the bandwidths of the band pass filters each having a test frequency of f1, f2, f3 or f4 as its center frequency. FIG. 1B is an exemplary measurement results of the audio clarity in the case where an audio is divided into divided frequencies f1 to f4, and the divided audios each having different frequency characteristics are outputted to the respective right and left ears.

For example, as shown in FIG. 1A, in the case where the bandwidth of an auditory filter is expanded at a frequency f3, it is possible to increase the clarity by performing band division at the frequency f3 as shown in FIG. 1B. This increase is made due to prevention of masking occurring between formant components of an audio (vowels and consonants) present around the frequency f3.

Otherwise, it is also possible to increase clarity by performing band division at a frequency f2 which is a frequency lower than the frequency f3. This increase is made due to prevention of masking occurring on the formant components of the consonants present around the frequency f3 by the formant components of the preceding vowels present at the frequency lower than the frequency f3.

Accordingly, based on information regarding expansion of the bandwidth of an auditory filter, it is possible to increase audio clarity for a greater number of listeners by setting optimum divided frequencies such as the frequencies f2 and f3.

Further, the inventors executed clarity tests of isolated syllables and clarity tests of VCV syllables for reception other than the lo dichotic listening, and compared these results with the results of the clarity tests of VCV syllables for the dichotic listening.

The comparison results showed that the clarity was significantly increased when VCV syllables were separately received at the respective ears of subjects who exhibited a significantly deteriorated clarity in the case where VCV syllables were received in a way other than the dichotic listening, compared with the case where isolated syllables were received in a way other than the dichotic listening.

The difference between an isolated syllable and a VCV syllable is presence/absence of a preceding vowel. Accordingly, since masking in time direction (temporal masking) by a preceding vowel in a VCV syllable is great, subjects who exhibit significantly deteriorated clarity can enjoy the advantageous effect of significantly increasing clarity by the dichotic listening.

Accordingly, it is possible to increase audio clarity for a greater number of listeners by applying and controlling the dichotic listening based on the information regarding the magnitude of the temporal masking.

Furthermore, it is possible to further increase the audio clarity by analyzing the input audio signal and setting the optimum divided frequencies together with the information regarding the expansion of the auditory filter and the information regarding the magnitude of the temporal masking.

Embodiments of the present invention will be described below with reference to the drawings.

(Embodiment 1)

Figure 2:
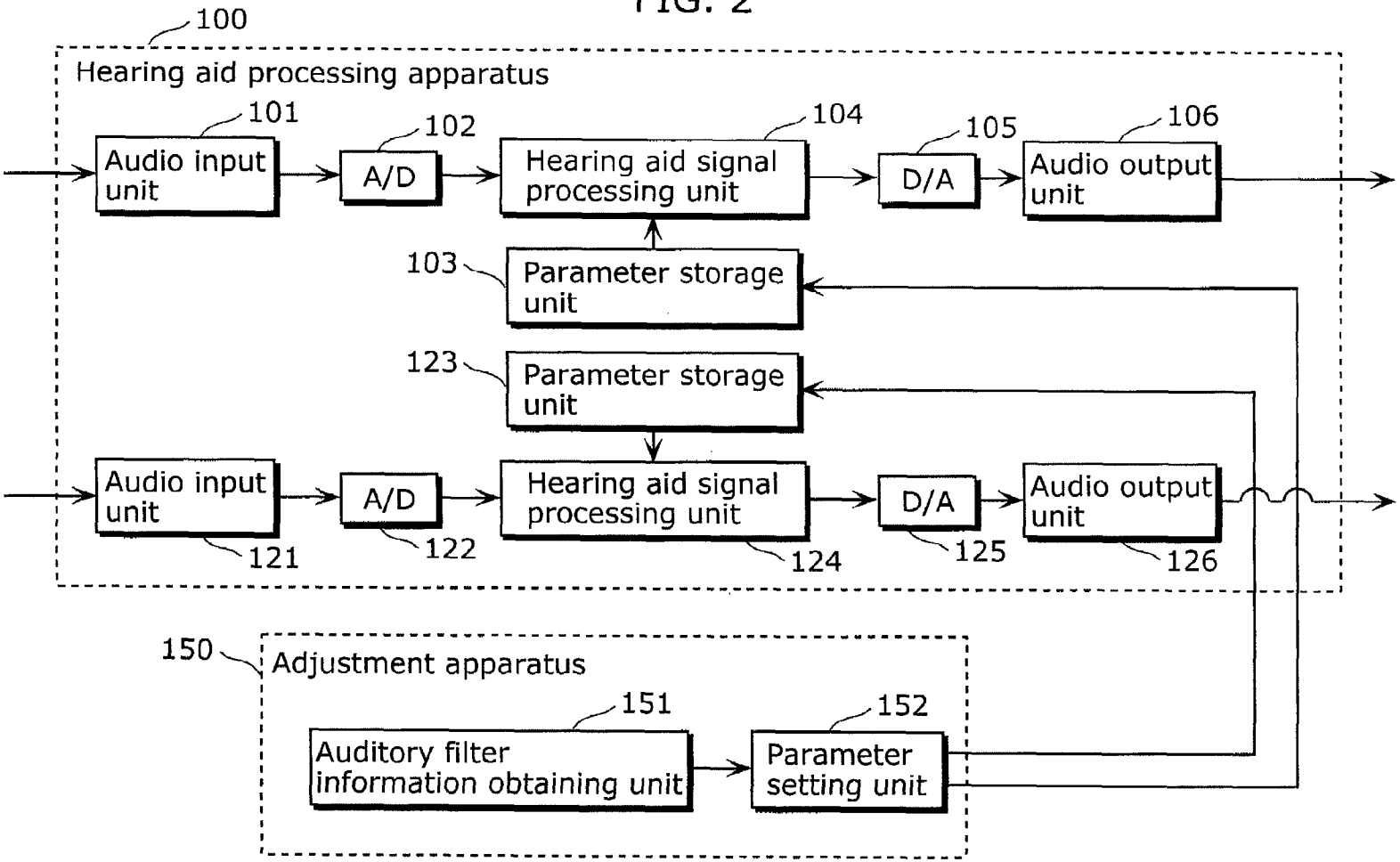
FIG. 2 is a block diagram of a hearing aid processing system according to Embodiment 1 of the present invention.
Figure 3A:
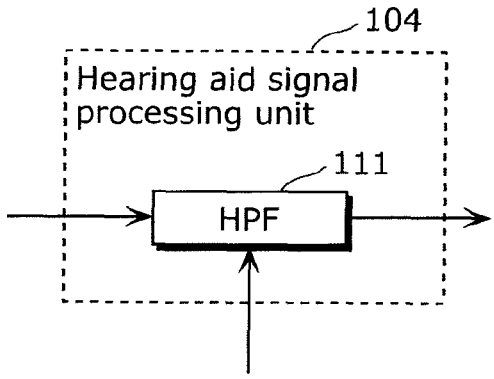
FIG. 3A is a block diagram showing an HPF mounted on a hearing aid signal processing unit.
Figure 3B:
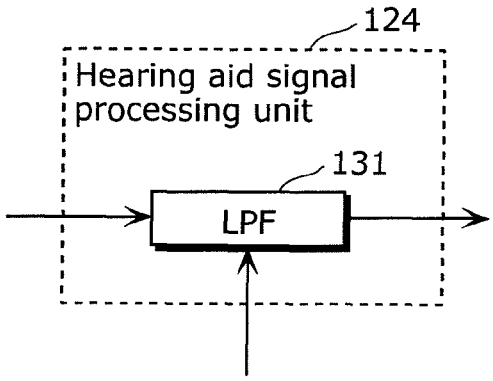
FIG. 3B is a block diagram showing an LPF mounted on a hearing aid signal processing unit.
Figure 4A:
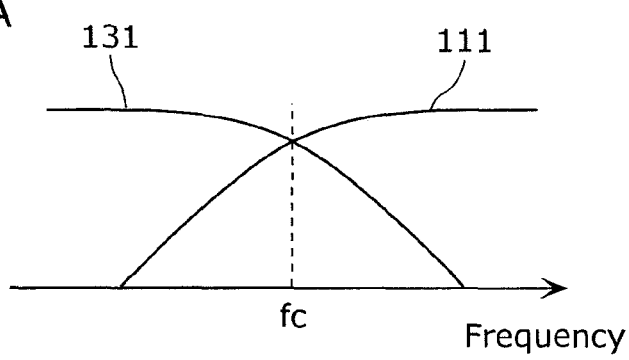
FIG. 4A is a diagram showing exemplary frequency characteristics of the HPF and the LPF shown in FIGS. 3A and 3B.
Figure 4B:
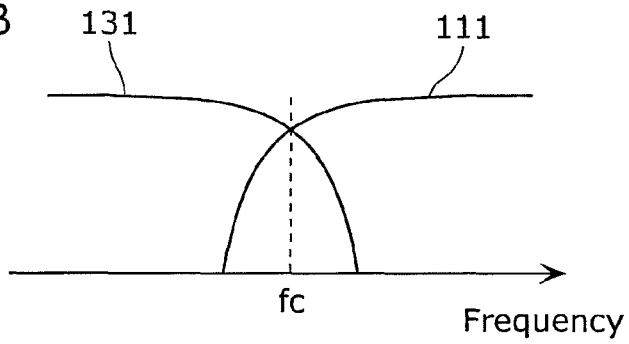
FIG. 4B is a diagram showing other exemplary frequency characteristics of the HPF and the LPF shown in FIGS. 3A and 3B.
Figure 4C:
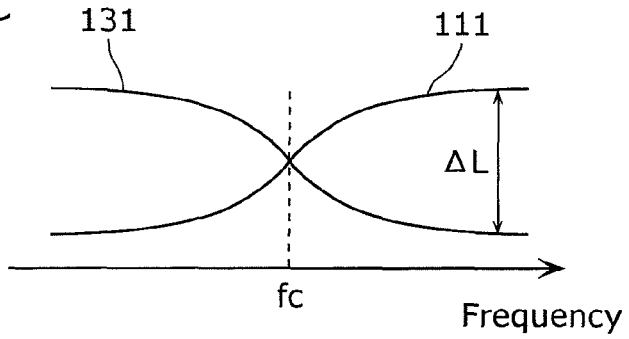
FIG. 4C is a diagram showing other exemplary frequency characteristics of the HPF and the LPF shown in FIGS. 3A and 3B.
Figure 4D:
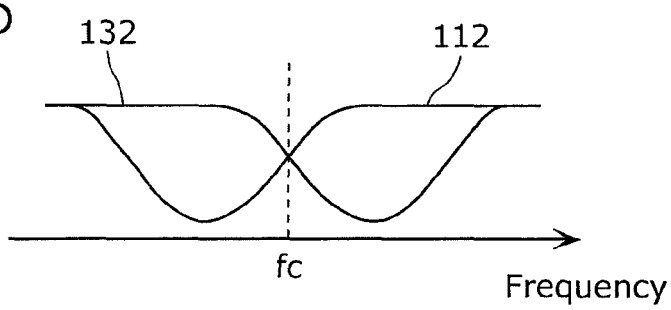
FIG. 4D is a diagram showing other exemplary frequency characteristics of the HPF and the LPF shown in FIGS. 3A and 3B.
Figure 5A:
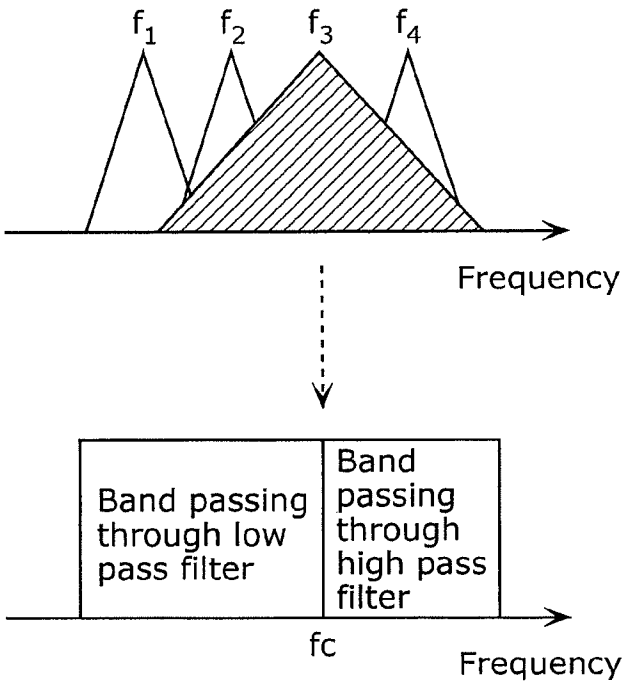
FIG. 5A is a diagram showing an example where a frequency at which the bandwidth of the auditory filter is expanded is assumed to be a cut-off frequency.
Figure 5B:
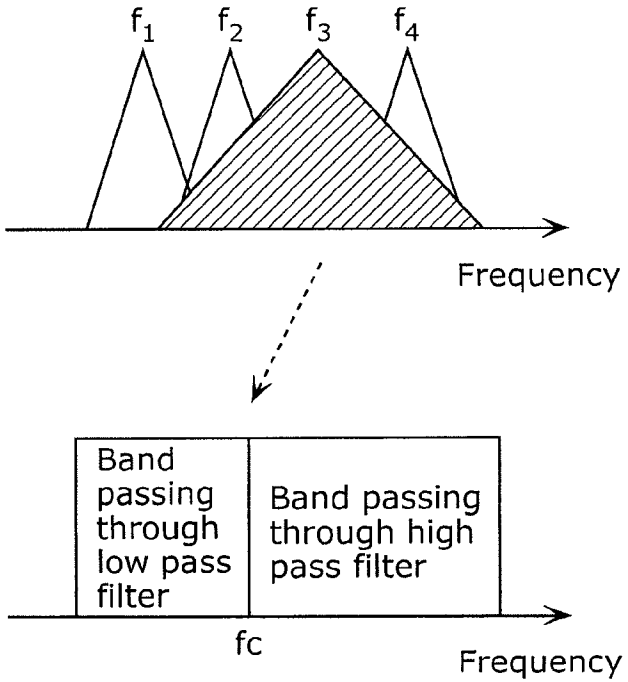
FIG. 5B is a diagram showing an example where a frequency below the frequency at which the auditory filter is expanded is assumed to be a cut-off frequency.

With reference to FIG. 2 to FIG. 5B, a description is given of a hearing aid processing system according to Embodiment 1 of the present invention. It is to be note that FIG. 2 is a block diagram of the hearing aid processing system, each of FIGS. 3A and 3B is a block diagram showing a filter mounted on the hearing aid processing system, each of FIGS. 4A and 4D is a block diagram showing the characteristics of the filter mounted on the hearing aid processing system, and each of FIGS. 5A and 5B is a diagram showing a method of selecting a cut-off frequency.

The hearing aid processing system according to Embodiment 1 of the present invention includes a hearing aid processing apparatus 100 and an adjustment apparatus 150 as shown in FIG. 2. Typically, the hearing aid processing apparatus 100 is a pair of hearing aids respectively attached to right and left ears. Typically, the adjustment apparatus 150 is a remote controller for setting various parameters to the hearing aid processing apparatus 100.

The hearing aid processing apparatus 100 includes: a pair of audio input units 101 and 121, a pair of A/D converters (analog to digital converters) 102 and 122, a pair of parameter storage units 103 and 123, a pair of hearing aid signal processing units 104 and 124, a pair of D/A converters (digital to analog converters) 105 and 125, and a pair of audio output units 106 and 126.

Each of the audio input units 101 and 121 receives an input audio signal which is converted into an electrical analog signal such as an output from a microphone of a hearing aid or an output from an audio device. The A/D converter 102 converts the analog signal inputted to the audio input unit 101 into a digital signal (input signal). The A/D converter 122 converts the analog signal inputted to the audio input unit 121 into a digital signal (input signal).

Each of the parameter storage units 103 and 123 is a storage unit (memory) for storing various parameters transmitted from the adjustment apparatus 150. More specifically, what are stored therein include a cut-off frequency fc, cut-off characteristics, and a level difference ΔL. In Embodiment 1, the parameters stored in the parameter storage units 103 and 123 have the same values, but it is to be noted that different values may be set, for example, in the case where different auditory filters are used for the respective right and left ears.

The hearing aid signal processing unit 104 generates a first output signal by performing hearing aid signal processing on the input signal based on the various parameters stored in the parameter storage unit 103. More specifically, as shown in FIG. 3A, the hearing aid signal processing unit 104 includes an HPF (high pass filter) 111 for attenuating frequency components below the cut-off frequency fc of the input signal to generate the first output signal.

The hearing aid signal processing unit 124 generates a second output signal by performing hearing aid signal processing on the input signal based on the various parameters stored in the parameter storage unit 123. Furthermore, as shown in FIG. 3B, the hearing aid signal processing unit 124 includes an LPF (low pass filter) 131 for attenuating frequency components at and above the cut-off frequency fc of the input signal to generate the second output signal.

Accordingly the first output signal outputted from the hearing aid signal processing unit 104 and the second output signal outputted from the hearing aid signal processing unit 124 are mutually different in frequency characteristics.

The D/A converter 105 converts the first output signal (digital signal) outputted from the hearing aid signal processing unit 104 into an analog signal. The D/A converter 125 converts the second output signal (digital signal) outputted from the hearing aid signal processing unit 124 into an analog signal.

The audio output unit 106 converts the analog signal outputted from the D/A converter 105 into an audio signal and outputs it to the left ear of the listener. The audio output unit 126 converts the analog signal outputted from the D/A converter 125 into an audio signal and outputs it to the right ear of the listener. At this time, since the first and second output signals outputted from the hearing aid signal processing units 104 and 124 are mutually different in frequency characteristics, different audios are outputted to the respective right and left ears of the listener.

The adjustment apparatus 150 includes an auditory filter information obtaining unit 151 and a parameter setting unit 152. The auditory filter information obtaining unit 151 obtains information related to the auditory filter of the listener in one or more frequency bands. The parameter setting unit 152 generates various parameters such as the cut-off frequency fc, the cut-off characteristics, and the level difference ΔL, based on the information related to the obtained auditory filter of the listener, and sets the generated parameters to the parameter storage units 103 and 123 of the hearing aid processing apparatus 100.

Next, the characteristics of the HPF 111 and the LPF 131 are described with reference to FIGS. 4A to 4D. As shown in FIG. 4A, each of the HPF 111 and the LPF 131 passes (or blocks) a predetermined band based on the common cut-off frequency fc. More specifically, the HPF 111 attenuates the frequency components below the cut-off frequency fc. On the other hand, the LPF 131 attenuates the frequency components at and above the cut-off frequency fc.

It is to be noted that the cut-off frequency fc is a variable that the adjustment apparatus 150 gives to the parameter storage units 103 and 123. In other words, it is desirable that each of the HPF 111 and the LPF 131 is configured to arbitrarily change the pass band (or stop band) depending on the value of the obtained cut-off frequency fc. Otherwise, it is also good to mount, in advance, HPFs 111 each having a different cut-off frequency on the hearing aid signal processing unit 104, and select an appropriate one of the HPFs 111 based on the cut-off frequency fc given to the parameter storage unit 103. The LPF 131 may be configured in the same manner.

In addition, as show in FIGS. 4A and 4B, it is desirable that the HPF 111 and the LPF 131 are configured to arbitrarily change the cut-off frequencies according to the parameters given to the parameter storage unit 103 and 123. Otherwise, it is also good to mount, in advance, HPFs 111 each having different cut-off characteristics on the hearing aid signal processing unit 104 and select an appropriate one of the HPFs 111 based on the parameter given to the parameter storage unit 103. The LPF 131 may be configured in the same manner.

In addition, as shown in FIG. 4C, the HPF 111 may be configured to be of a high-shelf type, and the LPF 131 may be configured to be of a low-shelf type. At this time, the hearing aid signal processing units 104 and 124 are required to obtain the level difference ΔL from the parameter storage units 103 and 123 in addition to the aforementioned cut-off frequency fc and cut-off characteristics. It is to be noted that the "level difference ΔL" indicates the maximum value of the difference in the frequency characteristics between the HPF 111 and the LPF 131.

Further, it is also good to mount BSFs (band stop filters) each having a different stop band on the hearing aid signal processing units 104 and 124, instead of mounting the HPF 111 and LPF 131 thereon. More specifically, as shown in FIG. 4D, the BSF 112 mounted on the hearing aid signal processing unit 104 attenuates only a predetermined low frequency band below the cut-off frequency fc to generate the first output signal from the input signal. On the other hand, the BSF 132 mounted on the hearing aid signal processing unit 124 attenuates only the predetermined frequency band at and above the cut-off frequency fc to generate the second output signal from the input signal.

In FIG. 4D, since only the audio in the frequency band around the cut-off frequency fc is divided for the respective right and left ears, and the audio of the frequency band distant from the cut-off frequency fc is at a same output level for the right and left ears, it is possible to output audios which sound natural to the listener.

Next, with reference to FIGS. 5A and 5B, descriptions are given of procedures taken by the adjustment apparatus 150 to determine various parameters. First, the auditory filter information obtaining unit 151 selects, for example, four center frequencies f1, f2, f3, and f4 from the band ranging from 250 Hz to 4000 Hz, and measures the bandwidths of the virtual band pass filters (auditory filter) at the respective center frequencies f1 to f4 for the listener. The upper parts of FIGS. 5A and 5B show the measurement results. According to the measurement results shown in FIGS. 5A and 5B, the bandwidth of the band pass filter is the greatest at the center frequency f3.

Next, the parameter setting unit 152 generates various parameters such as the cut-off frequency fc, the cut-off characteristics, and the level difference ΔL which determine the characteristics of the HPF 111 and the LPF 131, based on the measurement results by the auditory filter information obtaining unit 151.

The cut-off frequency fc is selected from the pass band (specific band) of the band pass filter (the band pass filter at the center frequency f3) having the greatest bandwidth. Typically, as shown in FIG. 5A, it is only necessary that the center frequency f3 of this band pass filter is determined to be the cut-off frequency fc. Otherwise, as shown in FIG. 5B, it is also good to select a cut-off frequency fc from the band at and below the center frequency f3 of the specific band, that is, select a cut-off frequency fc between the lowermost frequency and the center frequency f3 of the specific band. Accordingly, it is possible to reduce the influence of upward masking.

Cut-off characteristics are determined depending on the bandwidth of the specific band. For example, the influence of masking is not so significant in the case where the bandwidth of the specific band is small, and thus it is only necessary to employ a value for reducing the cut-off characteristics of the HPF 111 and the LPF 131 as shown in FIG. 4A. This increases the width of a band in which audios to be outputted to the respective right and left ears are overlapped with each other, and thus it is possible to output audios that sound more natural to the listener.

In contrast, the influence of masking is significant in the case where the bandwidth of the specific band is great, and thus it is only necessary to employ a value for making the cut-off characteristics of the HPF 111 and the LPF 131 sharper as shown in FIG. 4B. This reduces the width of a band in which audios to be outputted to the respective right and left ears are overlapped with each other, and thus it is possible to suppress the influence of masking between the frequency components.

The level difference ΔL is determined according to the bandwidth of the specific band as well as the cut-off characteristics. For example, since the influence of masking is not so significant in the case where the bandwidth of the specific band is small, the level difference ΔL between the HPF 111 and the LPF 131 is decreased. This decreases the difference in the frequency characteristics of audios outputted to the respective right and left ears, and thus it is possible to output audios that sound more natural to the listener.

On the other hand, since the influence of masking is great in the case where the bandwidth of the specific band is great, the level difference ΔL between the HPF 111 and the LPF 131 is increased. This increases the difference in the frequency characteristics of audios outputted to the respective right and left ears, and thus it is possible to suppress the influence of the masking between the frequency components.

The parameter setting unit 152 outputs, to the hearing aid processing apparatus 100, the various parameters determined based on the above standards. The hearing aid processing apparatus 100 stores the obtained various parameters in the parameter storage units 103 and 123.

The hearing aid processing apparatus 100 which has obtained the parameters can output audios each having different frequency characteristics to the respective right and left ears by performing hearing aid signal processing on the input audio. In Embodiment 1, the audio in the band at and above the cut-off frequency fc is outputted to the left ear, and the audio in the band below the cut-off frequency fc is outputted to the right ear. In addition, the band around the cut-off frequency fc is outputted to both the right and left ears in an overlapped manner.

In this way, in Embodiment 1, the auditory filter information obtaining unit 151 obtains the information regarding the auditory filter of the listener, and sets parameters such as the cut-off frequency fc, the cut-off characteristics, and the level difference ΔL of the HPF 111 and the LPF 131 depending on the listener, and the audio output units 106 and 126 output audios each having different frequency characteristics. In other words, it is possible to increase the clarity of audio for a greater number of listeners by means that the audio output units 106 and 126 separately output the outputs to the respective right and left ears.

It is to be noted that, in the example case of Embodiment 1, the audio input units 101 and 121, the A/D converters 102 and 122, the parameter storage units 103 and 123, the hearing aid signal processing units 104 and 124, and the D/A converters 105 and 125 are provided in pairs for the right and left ears, but the present invention is not limited to this. Most of these pairs may be a single functional block shared between the right and left ears. In other words, it is only necessary that at least the audio output units 106 and 126 are independent for the respective right and left ears.

In addition, the example describes the adjustment apparatus 150 which includes both the functional blocks of the auditory filter information obtaining unit 151 which measures the characteristics of the auditory filter for the listener and the parameter setting unit 152 which sets parameters to the hearing aid processing apparatus 100, but the present invention is not limited to this. These functional blocks may be independent. A possible configuration includes an exclusive device including the auditory filter information obtaining unit 151 which measures the characteristics of the auditory filter of the listener and a remote controller including the parameter setting unit 152 which is used to manually input each parameter.

(Embodiment 2)

Figure 6:
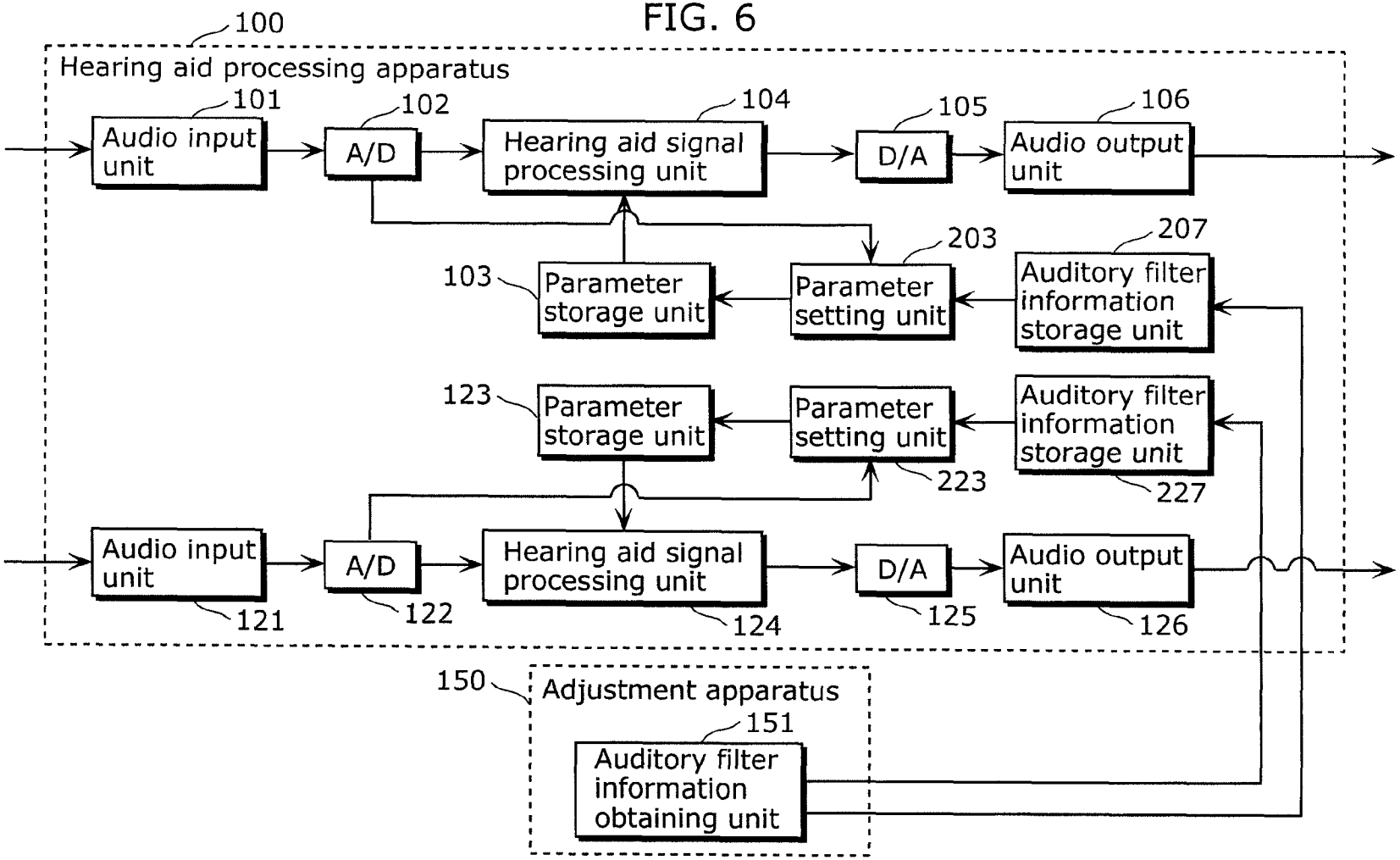
FIG. 6 is a block diagram of a hearing aid processing system according to Embodiment 2 of the present invention.

Next, with reference to FIG. 6, a description is given of a hearing aid processing system according to Embodiment 2 of the present invention. Embodiment 2 is configured to be approximately the same as Embodiment 1. Thus, the same elements are assigned with the same numerical references, and only the characterized elements are described here.

The auditory filter information storage units 207 and 227 store information related to auditory filter of a listener obtained by the auditory filter information obtaining unit 151 of the adjustment apparatus 150. More specifically, what is obtained from the adjustment apparatus 150 is information such as the width of the auditory filter (the bandwidth of the specific band) of the listener and the center frequency.

The parameter setting unit 203 generates various parameters such as the cut-off frequency fc, the cut-off characteristics, and the level difference ΔL, based on the input signal from the A/D converter 102 and the information related to the auditory filter stored in the auditory filter information storage unit 207, and stores these parameters in the parameter storage unit 103.

The parameter setting unit 223 generates various parameters such as the cut-off frequency fc, the cut-off characteristics, and the level difference ΔL, based on the input signal from the A/D converter 122 and the information related to the auditory filter stored in the auditory filter information storage unit 227, and stores these parameters in the parameter storage unit 123.

In Embodiment 2, it is to be noted that the input signals from the A/D converters 102 and 122 are the same, and the information stored in the auditory filter information storage units 207 and 227 are the same, and thus the values of the parameters generated by the parameter setting units 203 and 223 are the same. On the other hand, in the case where either input signals from the A/D converters 102 and 122 or information stored in the auditory filter information storage unit 207 and 227 are not the same, the parameter setting units 203 and 223 may generate different values.

Each of the parameter setting units 203 and 223 according to Embodiment 2 selects a cut-off frequency fc from the band between the center frequency of the specific band and the frequency of formant components of the vowels included in the audios inputted to the corresponding one of the audio input units 101 and 121.

Figure 7:
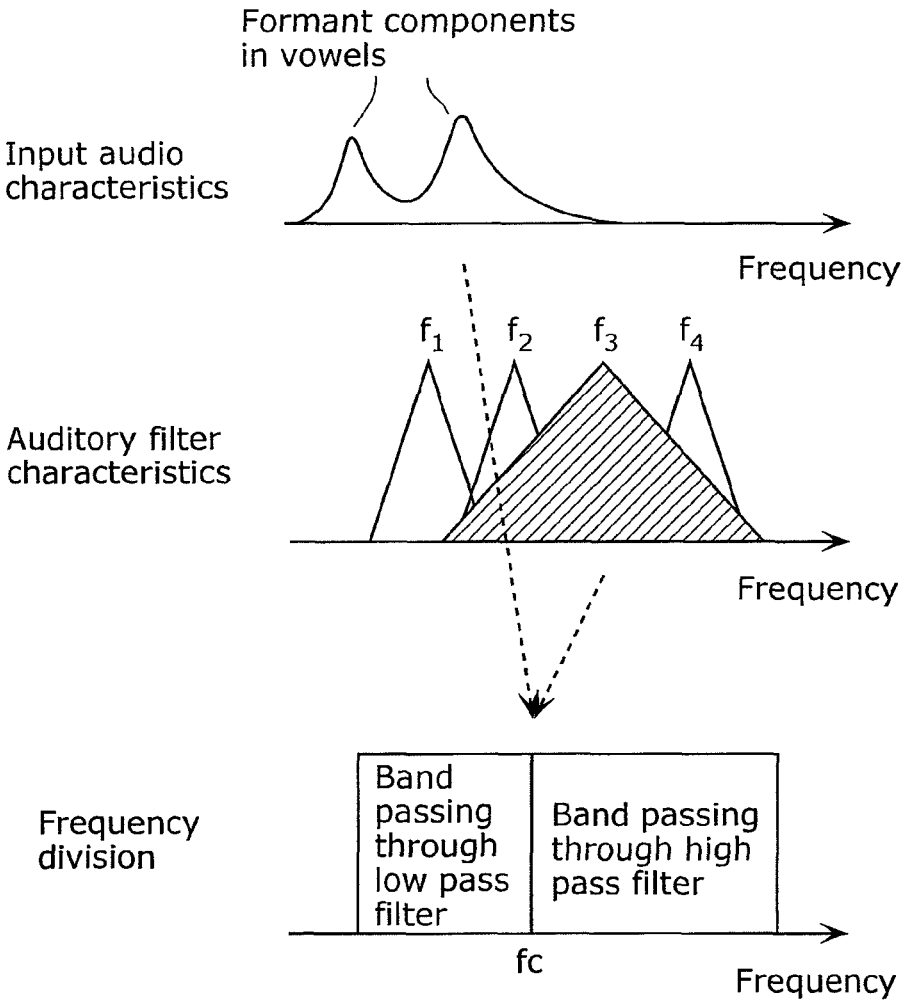
FIG. 7 is a diagram showing an example of determining a cut-off frequency based on an input audio signal and auditory filter information.

For example, in the case where the input audio signal includes formant components of vowels as shown in FIG. 7, it is only necessary that each of the parameter setting units 203 and 223 generates the cut-off frequency fc for the HPF 111 and LPF 131 such that the frequency band is divided at a frequency which (i) is around or below the center frequency of the specific band and (ii) is around or above the frequency of the formant components of the vowels, and sets the cut-off frequency fc to the corresponding one of the parameter storage units 103 and 123.

Further, each of the parameter setting units 203 and 223 may generate the cut-off characteristics of the HPF 111 and the LPF 131 according to the difference in the frequency between the center frequency of the specific band and the formant components of the vowels, and may set the cut-off characteristics to the corresponding one of the parameter storage units 103 and 123.

For example, the influence of masking is not so significant in the case where the difference in the frequency between the center frequency of the specific band and the frequency of the formant components of the vowels is great. Thus, as shown in FIG. 4A, it is only necessary that each of the parameter setting units 203 and 223 sets a value for reducing the cut-off characteristics of the HPF 111 and the LPF 131.

In contrast, the influence of masking is significant in the case where the difference in the frequency between the center frequency of the specific band and the frequency of the formant components of the vowels is small. Thus, as shown in FIG. 4B, it is only necessary that each of the parameter setting units 203 and 223 sets a value for making the cut-off characteristics of the HPF 111 and the LPF 131 sharper.

In this way, in Embodiment 2, each of the parameter setting units 203 and 223 sets the cut-off frequency fc for the HPF 111 and the LPF 131 with consideration of the frequency characteristics of the input signal in addition to the information related to the auditory filter of the listener. Since the frequency characteristics of the input audio change with time, a selection of the optimum cut-off frequency fc at the current moment makes it possible to further increase the audio clarity.

It is to be noted that the parameter setting unit 203 and 223 may generate parameters such as the cut-off frequency fc, the cut-off characteristics, the level difference ΔL with consideration of the high frequency band having the highest energy level of the input signal instead of using the formant components of the vowels, or may generate parameters with consideration of the formant components of consonants in the case where the formant components of the consonants are present in the frequency band close to the frequency band of the vowels.

(Embodiment 3)

Figure 8:
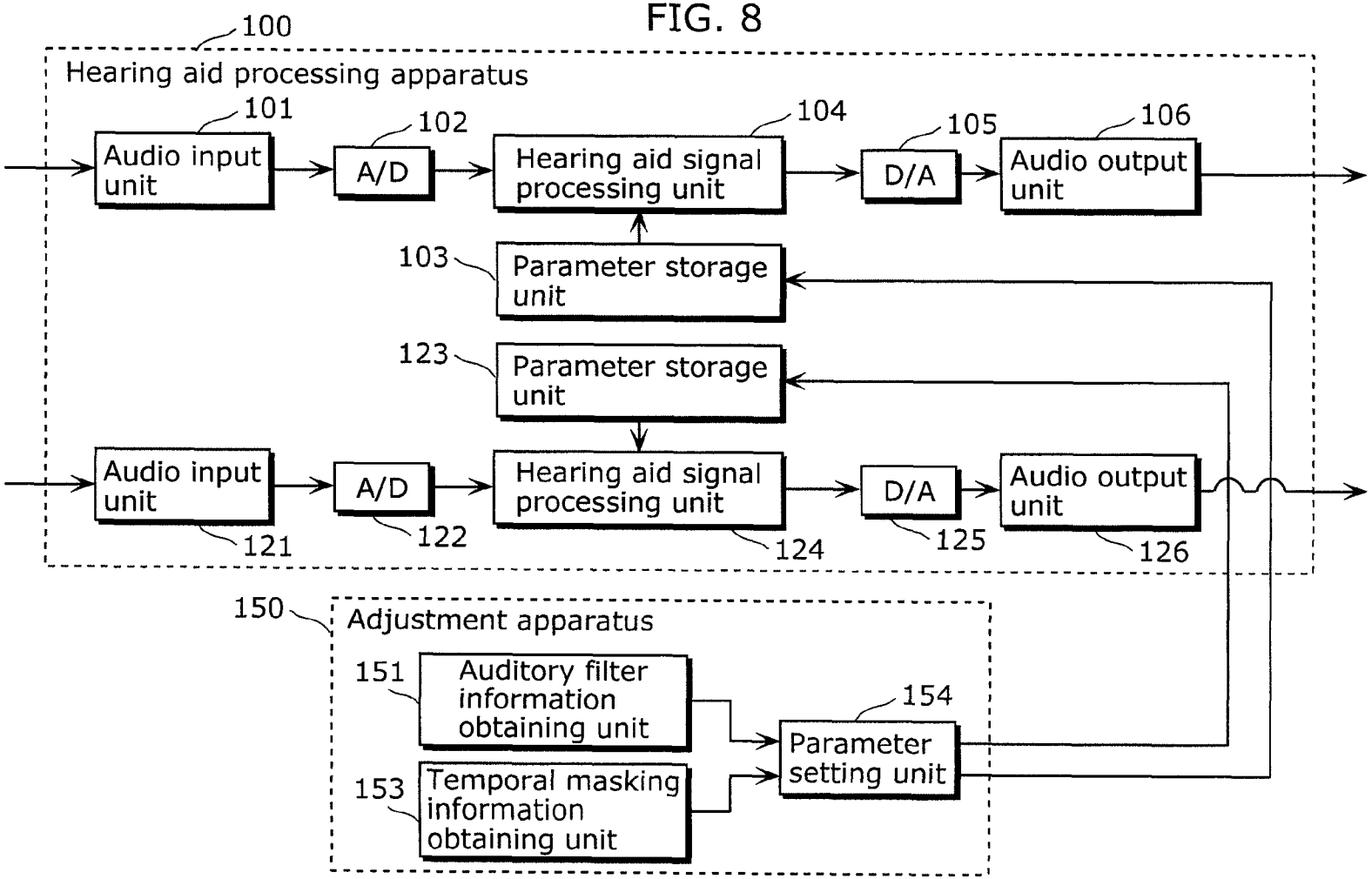
FIG. 8 is a block diagram of a hearing aid processing system according to Embodiment 3 of the present invention.

Next, with reference to FIG. 8, a description is given of a hearing aid processing system according to Embodiment 3 of the present invention. It is to be noted that the description given in Embodiment 1 is not repeated here, and the differences are mainly described. The adjustment apparatus 150 according to Embodiment 3 further includes a temporal masking information obtaining unit 153 which obtains information related to temporal masking characteristics of a listener.

Figure 9A:
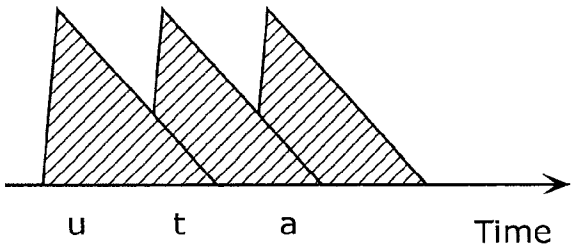
FIG. 9A is a diagram showing exemplary temporal masking characteristics of a normal hearing person.
Figure 9B:
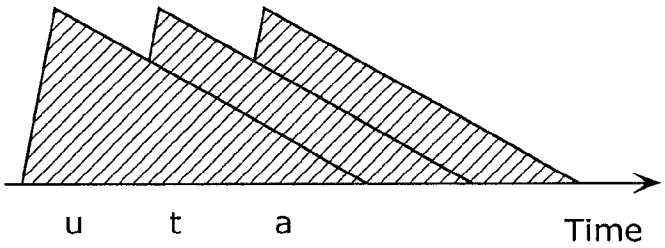
FIG. 9B is a diagram showing exemplary temporal masking characteristics regarding a hearing-impaired person.

It is to be noted that "temporal masking characteristics" indicate the degree of resolution of temporally adjacent audio components. More specifically, the "temporal masking characteristics" indicate a time length by which an audio of the specific frequency affects a temporally-succeeding (or preceding) audio. For example, "high temporal masking characteristics" show that the time length by which each audio component masks the succeeding audio component is relatively short as shown in FIG. 9A. On the other hand, "low temporal masking characteristics" show that the time length by which each audio component masks the succeeding audio component is relatively long as shown in FIG. 9B.

The parameter setting unit 154 generates various parameters such as the cut-off frequency fc, the cut-off characteristics, the level difference ΔL, based on the information related to the auditory filter of the listener and the information related to the temporal masking characteristics of the listener, and sets these parameters in the parameter storage units 103 and 123 of the hearing aid processing apparatus 100.

The temporal masking information obtaining unit 153 obtains information of the listener's temporal masking characteristics using an approach such as the approach shown in Non-patent Reference 3.

Otherwise, as shown in the aforementioned clarity tests, it is also possible to obtain information of the listener's temporal masking characteristics by comparing the clarity of a short audio (for example, an isolated syllable and the clarity of a longer audio (such as a VCV syllable).

The parameter setting unit 154 generates cut-off characteristics for the HPF 111 and the LPF 131 also depending on the degree of temporal masking characteristics in addition to operations performed by the parameter setting unit 152, and sets these cut-off characteristic to the parameter storage units 103 and 123. As in Embodiment 1, in the case where the temporal masking characteristics of a listener are different between the right and left ears, it is also good to set different values to the parameter storage units 103 and 123.

For example, in the case where the temporal masking characteristics is high as shown in FIG. 9A, the parameter setting unit 154 may set values for reducing the cut-off characteristics for the HPF 111 and the LPF 131 as shown in FIG. 4A. Otherwise, the parameter setting unit 154 may set values for disabling the HPF 111 and the LPF 131, that is, values for passing all the bands through.

In contrast, in the case where the temporal masking characteristics is low as shown in FIG. 9B, the parameter setting unit 154 may set values for making the cut-off characteristics for the HPF 111 and the LPF 131 sharper as shown in FIG. 4B.

With this configuration, it is possible to further increase audio clarity because of the reduction in the influence of temporal masking in addition to the reduction in the influence of masking occurring between frequency components. In particular, audios are characterized in that consonant components having a relatively high frequency and vowel components having a relatively low frequency are consecutive therein. For this, it is possible to significantly reduce the influence of temporal masking by outputting the high frequency components (consonant components) to one of the right and left ears and outputting low frequency components (vowel components) to the other.

(Embodiment 4)

Figure 10:
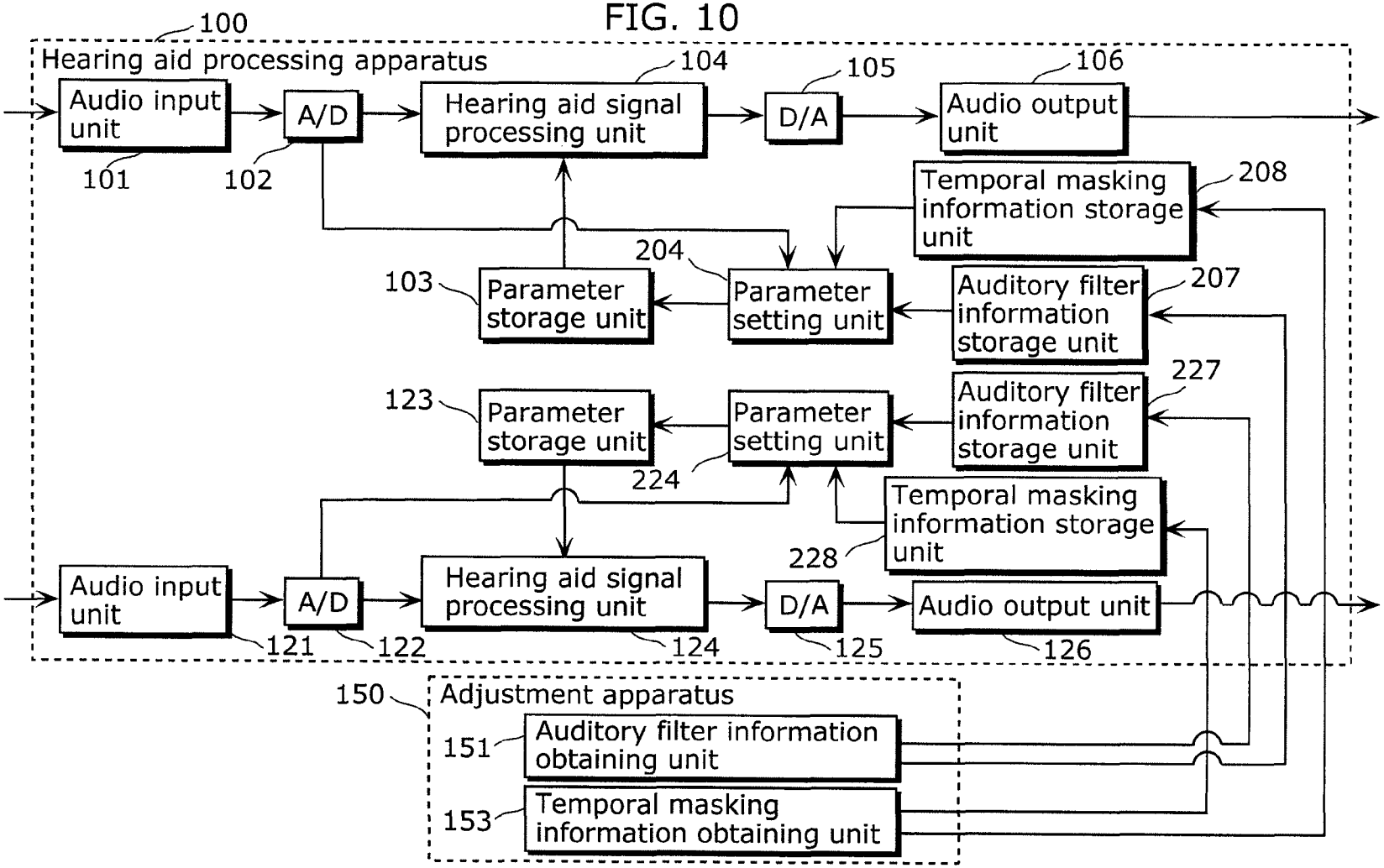
FIG. 10 is a block diagram of a hearing aid processing system according to Embodiment 4 of the present invention.

Next, with reference to FIG. 10, a description is given of a hearing aid processing system according to Embodiment 4 of the present invention. It is to be noted that the descriptions given in Embodiments 1 to 3 are not repeated here, and the differences are mainly described.

The adjustment apparatus 150 further includes a temporal masking information obtaining unit 153 which obtains information related to temporal masking characteristics of a listener. The hearing aid processing apparatus 100 further includes temporal masking information storage units 208 and 228 each of which stores information related to the listener's temporal masking characteristics obtained by the temporal masking information obtaining unit 153.

The parameter setting unit 204 generates various parameters such as a cut-off frequency fc, cut-off characteristics, and a level difference ΔL, based on the input signal inputted from the A/D converter 102, the information related to the auditory filter stored in the auditory filter information storage unit 207, and the information related to the temporal masking characteristics stored in the temporal masking information storage unit 208, and stores these parameters in the parameter storage unit 103.

The parameter setting unit 224 generates various parameters such as the cut-off frequency fc, the cut-off characteristics, and the level difference ΔL, based on the input signal inputted from the A/D converter 122, the information related to the auditory filter stored in the auditory filter information storage unit 227, and the information related to the temporal masking characteristics stored in the temporal masking information storage unit 228, and stores these parameters in the parameter storage unit 123.

In each of the above-described Embodiments, the hearing aid signal processing units 104 and 124 are configured to include the HPF 111 and the LPF 131, respectively. However, it is to be noted that these HPF and LPF may be exchanged in advance or adaptively in the configuration because, in general, these HPF and LPF can be easily modified to the opposite filters by modifications of their filter coefficients. For example, an HPF may be assigned to the ear having a better hearing ability in a high frequency band depending on the hearing ability characteristics of a listener, or an HPF may be assigned to the audio having a greater number of high frequency components depending on the audio signals from the audio input units 101 and 121.

Although the case described above is a case of dividing a band into two bands of a low band and a high band, it is only necessary that audio signals having mutually different frequency characteristics are outputted to the respective ears. For example, a band limitation may be made on only one of the ears, or the band may be divided into plural bands using a band pass filter (BPF).

Alternatively, it is also good to output audios in the band at which the bandwidth of the auditory filter is not expanded to both the ears, that is, to separately output the audios in the band at which the bandwidth of the auditory filter is expanded to the respective right and left ears.

In addition, the above-described case is a case of using a divided frequency fc as a parameter for performing frequency division, but it is also good to use numerical values related to the divided frequency fc (for example, to use numerical references for bands when hearing aid processing is performed on a per band basis). Alternatively, it is also good to select one of previously set values (such that a greater number of listeners can enjoy an advantageous effect or such that a specific listener can enjoy the optimum result). This is true of the other parameters.

Alternatively, it is also good that a listener selects one of previously prepared parameters which yields the highest audio clarity or adjusts parameters, without mounting the auditory filter information obtaining unit 151 and the temporal masking information obtaining unit 153.

In addition, the present invention may be implemented not only as the hearing aid processing apparatus 100 and the adjustment apparatus 150, but also as a hearing aid processing method and as a program causing a computer to execute the adjustment method for use with the hearing aid processing apparatus 100.

In addition, the hearing aid processing apparatus 100 and the adjustment apparatus 150 in these Embodiments can be implemented in form of LSIs which are typical integrated circuits. In this case, these LSIs may be configured in a single chip, or may be configured in plural chips. For example, the functional blocks other than a memory may be integrated into one-chip LSI. The name used here is LSI, but it may also be called IC, system LSI, super LSI, or ultra LSI depending on the degree of integration.

Moreover, ways to achieve integration are not limited to the LSI, and special circuit or general purpose processor can also achieve the integration. Field Programmable Gate Array (FPGA) that can be programmed after manufacturing LSI or a reconfigurable processor that allows re-configuration of the connection or configuration of LSI can be used for the same purpose.

Further, with advancement in technology of manufacturing semiconductors or other derivative technique, a new integration technology resulting in replacement of LSI may emerge. The integration may be carried out using this technology. Application of biotechnology is one such possibility.

Embodiments of the present invention have been described with reference to the drawings, but the present invention is not limited to the illustrated Embodiments. Various corrections and modifications are possible to the illustrated Embodiments within the same scope of the present invention or within the scope of equivalent matters.

As described above, the hearing aid processing apparatus according to the present invention provides an advantageous effect of being able to increase audio clarity depending on an input signal and a listener, and thus is applicable to general apparatuses which perform audio reproduction and audio communication. Examples of such apparatuses include hearing aids, acoustic devices, mobile phones, and public address systems.

The invention claimed is:

1. A hearing aid processing system, comprising:

a hearing aid processing apparatus which outputs an audio signal which has been subjected to hearing aid signal processing to ears of a listener; and an adjustment apparatus which outputs parameters used in the hearing aid signal processing to the hearing aid processing apparatus, wherein the adjustment apparatus includes:

an auditory filter information obtaining unit that obtains characteristics of a band pass filter having a greatest bandwidth in an auditory filter of the listener; and a parameter setting unit that generates the parameters based on the characteristics obtained by the auditory filter information obtaining unit, and assigns the parameters to the hearing aid signal processing units, and the hearing aid processing apparatus includes:

an audio input unit that receives an input audio signal;

the hearing aid signal processing units that generate first and second output signals each having different frequency characteristics, from an input signal based on the input audio signal inputted by the audio input unit, by executing the hearing aid signal processing based on the parameters obtained from the parameter setting unit;

a first audio output unit that outputs, as an audio signal, the first output signal generated by one of the hearing aid signal processing units to one of a left ear and a right ear of the listener; and a second audio output unit that outputs, as an audio signal, the second output signal generated by the other one of the hearing aid signal processing units to the other one of the left ear and the right ear of the listener, wherein the hearing aid processing apparatus includes:

a first band stop filter, as a high pass filter in the one of the hearing aid signal processing units, which attenuates only a predetermined low frequency band below a cut-off frequency selected in a specific band which is a band of the band pass filter having the greatest bandwidth so as to generate the first output signal from the input signal, and a second band stop filter, as a low pass filter in the other one of the hearing aid signal processing units, which attenuates only a predetermined high frequency band at and above the cut-off frequency so as to generate the second output signal from the input signal.

2. The hearing aid processing system according to claim 1, wherein the cut-off frequency is selected in a band at and below a center frequency of the specific band.

3. The hearing aid processing system according to claim 1, wherein the cut-off frequency is selected in a band between a center frequency of the specific band and a frequency of a formant component included in the input audio signal received by the audio input unit.

4. The hearing aid processing system according to claim 3, wherein the hearing aid processing apparatus creates cut-off characteristics of a high pass filter and a low pass filter that are sharper with a decrease in difference between the center frequency of the specific band and the frequency of the formant component.

5. The hearing aid processing system according to claim 1, wherein the parameter setting circuit generates parameters for creating cut-off characteristics of filters composing the hearing aid signal processing units that are sharper with an increase in bandwidth of a specific band which is a band of the band pass filter having the greatest bandwidth.

6. The hearing aid processing system according to claim 1, wherein the hearing aid processing apparatus generates parameters for creating cut-off characteristics of a high pass filter and a low pass filter composing the hearing aid signal processing units that are sharper with a decrease in listener's temporal masking characteristics indicating a degree of resolution of a temporally-adjacent audio signal.

7. The hearing aid processing system according to claim 1, wherein the hearing aid signal processing units includes:

a high shelf filter which generates the first output signal from the input signal; and a low shelf filter which generates the second output signal from the input signal, wherein the parameter setting unit generates parameters for increasing a level difference more significantly with an increase in bandwidth of a specific band which is a band of the band pass filter having the greatest bandwidth, the level difference being a maximum difference value between frequency characteristics of the high pass filter and frequency characteristics of the low pass filter.

8. The hearing aid processing system according to claim 1, wherein the auditory filter information obtaining unit obtains characteristics of the listener's band pass filter having the greatest bandwidth using a notch noise method.

9. A hearing aid processing method for a hearing aid processing system in which a hearing aid processing apparatus outputs an audio signal which has been subjected to hearing aid signal processing to ears of a listener, and an adjustment apparatus outputs parameters used in the hearing aid signal processing to the hearing aid processing apparatus,the hearing aid processing method comprising:

in the adjustment apparatus:

obtaining, using an auditory filter information obtaining unit, characteristics of a band pass filter having a greatest bandwidth in an auditory filter of the listener; and generating, using a parameter setting unit, the parameters based on the characteristics obtained by the auditory filter information obtaining unit, and assigning the parameters to hearing aid signal processing units, and in the hearing aid processing apparatus:

receiving an input audio signal;

generating, using hearing aid signal processing units first and second output signals each having different frequency characteristics, from an input signal based on the input audio signal received, and based on characteristics of a band pass filter having a greatest bandwidth among virtual band pass filters composing an auditory filter of a listener;

outputting, as an audio signal, the first output signal generated by one of the hearing aid signal processing units to one of a left ear and a right ear of the listener; and outputting, as an audio signal, the second output signal generated by the other one of the hearing aid signal processing units to the other one of the left ear and the right ear of the listener, wherein the first output signal is generated from the input signal, using a first band stop filter as a high pass filter in the one of the hearing aid signal processing units, and by attenuating only a predetermined low frequency band below a cut-off frequency selected in a specific band which is a band of the band pass filter having the greatest bandwidth, and the second output signal is generated from the input signal, using a second band stop filter as a low pass filter in the other one of the hearing aid signal processing units, and by attenuating only a predetermined high frequency band at and above the cut-off frequency.

10. A non-transitory computer-readable recording medium storing programs for performing a hearing aid processing for a hearing aid processing system in which a hearing aid processing apparatus outputs an audio signal which has been subjected to hearing aid signal processing to ears of a listener, and an adjustment apparatus outputs parameters used in the hearing aid signal processing to the hearing aid processing apparatus, the programs causing a computer to execute steps comprising:

in the adjustment apparatus:

obtaining, using an auditory filter information obtaining unit, characteristics of a band pass filter having a greatest bandwidth in an auditory filter of the listener; and generating, using a parameter setting unit, the parameters based on the characteristics obtained by the auditory filter information obtaining unit, and assigning the parameters to hearing aid signal processing units, and in the hearing aid processing apparatus:

receiving an input audio signal;

generating, using hearing aid signal processing units, first and second output signals each having different frequency characteristics, from an input signal based on the input audio signal received , and based on characteristics of a band pass filter having a greatest bandwidth among virtual band pass filters composing an auditory filter of a listener;

outputting, as an audio signal, the first output signal generated by one of the hearing aid signal processing units to one of a left ear and a right ear of the listener; and outputting, as an audio signal, the second output signal generated by the other one of the hearing aid signal processing units to the other one of the left ear and the right ear of the listener, wherein the first output signal is generated from the input signal, using a first band stop filter as a high pass filter in the one of the hearing aid signal processing units, and by attenuating only a predetermined low frequency band below a cut-off frequency selected in a specific band which is a band of the band pass filter having the greatest bandwidth, and the second output signal is generated from the input signal, using a second band stop filter as a low pass filter in the other one of the hearing aid signal processing units, and by attenuating only a predetermined high frequency band at and above the cut-off frequency.

11. Integrated circuits for a hearing aid processing system in which a hearing aid processing apparatus outputs an audio signal which has been subjected to hearing aid signal processing to ears of a listener, and an adjustment apparatus which outputs parameters used in the hearing aid signal processing to the hearing aid processing apparatus, the integrated circuits comprising:

in the adjustment apparatus:

an auditory filter information obtaining unit that obtains characteristics of a band pass filter having a greatest bandwidth in an auditory filter of the listener; and a parameter setting unit that generates the parameters based on the characteristics obtained by the auditory filter information obtaining unit, and assigns the parameters to hearing aid signal processing units, and in the hearing aid processing apparatus:

an audio input unit that receives an input audio signal;

hearing aid signal processing units that generate first and second output signals each having different frequency characteristics, from an input signal based on the input audio signal received by the audio input unit, and based on characteristics of a band pass filter having a greatest bandwidth among virtual band pass filters composing an auditory filter of a listener;

a first audio output unit that outputs, as an audio signal, the first output signal generated by one of the hearing aid signal processing units to one of a left ear and a right ear of the listener; and a second audio output unit that outputs, as an audio signal, the second output signal generated by the other one of the hearing aid signal processing units to the other one of the left ear and the right ear of the listener, wherein the hearing aid processing apparatus includes:

a first band stop filter, as a high pass filter in the one of the hearing aid signal processing units, which attenuates only a predetermined low frequency band below a cut-off frequency selected in a specific band which is a band of the band pass filter having the greatest bandwidth so as to generate the first output signal from the input signal, and a second band stop filter, as a low pass filter in the other one of the hearing aid signal processing units, which attenuates only a predetermined high frequency band at and above the cutoff frequency so as to generate the second output signal from the input signal.

* * * * *